US007656372B2

(12) United States Patent
Sato et al.

(10) Patent No.: US 7,656,372 B2
(45) Date of Patent: Feb. 2, 2010

(54) METHOD FOR DRIVING LIQUID CRYSTAL DISPLAY DEVICE HAVING A DISPLAY PIXEL REGION AND A DUMMY PIXEL REGION

(75) Inventors: Tetsushi Sato, Tokyo (JP); Hiroyuki Sekine, Tokyo (JP)

(73) Assignee: NEC Corporation, Tokyo (JP)

( * ) Notice: Subject to any disclaimer, the term of this patent is extended or adjusted under 35 U.S.C. 154(b) by 726 days.

(21) Appl. No.: 11/063,539

(22) Filed: Feb. 24, 2005

(65) Prior Publication Data

US 2005/0184980 A1 Aug. 25, 2005

(30) Foreign Application Priority Data

Feb. 25, 2004 (JP) ..... 2004-049104

(51) Int. Cl.
*G09G 3/36* (2006.01)

(52) U.S. Cl. ..... 345/87; 349/151

(58) Field of Classification Search ..... 345/38, 345/50, 55, 84, 87, 103, 204; 349/138, 149, 349/151, 153, 152, 187
See application file for complete search history.

(56) References Cited

U.S. PATENT DOCUMENTS 6,266,039 B1 * 7/2001 Aoki ..... 345/94
7,391,398 B2 * 6/2008 Inoue ..... 345/89
2002/0130829 A1 * 9/2002 Ilda et al. ..... 345/87
2004/0032554 A1 * 2/2004 Yoon et al. ..... 349/113

FOREIGN PATENT DOCUMENTS

| | | | |
|---|---|---|---|
| JP | 2590992 | B2 | 12/1996 |
| JP | 2605799 | B2 | 2/1997 |
| JP | 10-170935 | A | 6/1998 |
| JP | 2000-098411 | A | 4/2000 |
| JP | 2001-166322 | A | 6/2001 |
| JP | 2002-350885 | A | 12/2002 |

* cited by examiner

*Primary Examiner*—Chanh Nguyen
*Assistant Examiner*—Pegeman Karimi
(74) *Attorney, Agent, or Firm*—Sughrue Mion, PLLC

(57) ABSTRACT

An object is to prevent a defective indication caused by a reverse twisted domain generated from the dummy pixel region which is provided in the periphery of a display pixel region. By setting a signal voltage to be applied to the pixels of the dummy pixel region to be lower than the maximum value of a video signal voltage which is applied to the display pixel region and also setting it to be in a level by which a defective indication is not caused due to a traverse electric field between the neighboring dummy pixel region and the display pixel region, generation of the reverse twisted domain within the dummy pixel region can be suppressed. Thereby, the defective indication caused by the reverse twist can be prevented.

22 Claims, 9 Drawing Sheets

METHOD FOR DRIVING LIQUID CRYSTAL DISPLAY DEVICE HAVING A DISPLAY PIXEL REGION AND A DUMMY PIXEL REGION

BACKGROUND OF THE INVENTION

1. Field of the Invention

The present invention relates to a method for driving a liquid crystal display device which comprises a pixel region constituted of a display pixel region in which a plurality of pixels are arranged in matrix and a dummy pixel region arranged in the periphery of the display pixel region.

2. Description of the Related Art

FIG. 1 is a plan view for showing a pixel region in a conventional liquid crystal display device driving method. Description will be provided hereinafter by referring to the drawing.

In order to make an optical property of the entire display pixel region 1, in which a number of pixels are arranged in matrix, uniform for a liquid crystal applied voltage of the entire display pixel region 1 in which a number of pixels are arranged in matrix, a dummy pixel region 2 which does not directly contribute to a picture display is provided in the outer periphery of the display pixel region 1. Further, in the driving method, the voltage to be applied to a pixel electrode of the dummy pixel region 2 is set to be the maximum value of a video signal voltage which is applied to the pixel electrode of the display pixel region 1. The reason will be described in the followings.

FIG. 2 is a cross section taken along the line X of FIG. 1. Description will be provided hereinafter by referring to the drawing.

Lines illustrated within a liquid crystal layer 33 show electric flux lines which are generated when the same voltage as that of a counter electrode 34 is applied to a dummy pixel electrode 31 and the maximum value of the video signal voltage is applied to a display pixel electrode 32 of the display pixel region 1. In the state where the voltages are applied in the manner as described above, a transverse electric field is generated in the liquid crystal layer 33 in a boundary area 35 between the dummy pixel region 2 and the display pixel region 1. Thus, liquid crystal molecules are in a laid position (that is, facing the sideways). Therefore, the transmissivity of the liquid crystal layer 33 in the vicinity of the boundary region 35 becomes different from that of the center area of the display pixel region 1, thereby deteriorating the display quality. More specifically, in the case of a normally white system which displays white when a voltage is not applied to the liquid crystal of the liquid crystal layer 33, if a voltage is applied to display black over the entire display pixel region 1 and to display white in the dummy pixel region 2, the periphery of the display pixel region 1 looks whitish due to a leakage of the light.

In order to avoid the above-described phenomenon, the maximum value of the voltage to be applied to the display pixel electrode 32 may be applied to the dummy pixel electrode 31. This can be supported by Japanese Patent No. 2590992 (FIG. 5, 47-50 lines in right section on page 2).

However, as in the related art as described above, when the voltage to be applied to the dummy pixel electrode 31 is set to be the maximum value of the video signal voltage which is applied to the display pixel electrode 32, a reverse twisted domain is generated within the dummy pixel region 2. And if the influence spreads to the display pixel region 1, it causes a defective indication. The defective indication will be described in the followings by referring to a case of using a gate line inversion driving method.

The reverse twisted domain is generated from the state where the liquid crystal molecules are in a rise-up state, and it is more likely to be generated when the extent of the rise of the liquid crystal molecules is prominent. In other words, it is more likely to be generated when the higher voltage is applied to the liquid crystal layer 33.

The dummy pixels within the dummy pixel region 2 do not have apertures, that is, the entire dummy pixels are covered by a shield film so that there is almost no photoelectric current leakage generated from a switching element (referred to as TFT (thin film transistor) hereinafter) contained in the dummy pixel.

Therefore, even when the same voltage as that of the display pixel region 1 is applied to the dummy pixel region 2, the higher voltage is maintained in the dummy pixel region 2 after one frame period, compared to the display pixel region 1 which has the apertures. Thus, in the dummy pixel region 2, the liquid crystal molecules rise up to a larger extent. Moreover, the maximum voltage to be applied to the display pixel electrode 32 is continued to be applied to the dummy pixel region 2 constantly so that the liquid crystal molecules always maintain the rise-up state.

Since the polarities of the voltage to be applied to the liquid crystal are changed for each line of the pixel matrix in the gate line inversion driving method, there are transverse electric fields generated between the pixel electrodes in the vertical direction of the screen provided that a plurality of gate lines are arranged on the screen in parallel in the vertical direction. The liquid crystal molecules in the region of the transverse electric field are likely to cause abnormal orientation, so that it is likely to generate the reverse twist. When there is the reverse twisted domain generated between the pixels on the neighboring gate lines within the dummy pixel region 2, the influence of the reverse twisted domain spreads to the peripheral liquid crystal molecules. The reverse twisted domain propagates to the display pixel region 1 from the dummy pixel region 2. That is, in the case of the gate line inversion driving method, the reverse twisted domain generated within the dummy pixel region 2 propagates to the display pixel region 1 along the gate line, thereby causing the defective indication with horizontal lines being generated in the display pixel region 1 along the gate line.

SUMMARY OF THE INVENTION

An object of the present invention is to provide a method for driving a liquid crystal display device which enables to overcome the defective indication caused in the display pixel region due to the reverse twist through preventing the generation of reverse twisted domain in the dummy pixel region and the generation of light leakage in the boundary area between the display pixel region and the dummy pixel region.

As described above, in a related art, the voltage is not applied to the liquid crystals of the dummy pixel region so that the light leakage is generated in the boundary area between the display pixel region and the dummy pixel region. Also, in another related art, the maximum value of the video signal voltage to be applied to the liquid crystals of the display pixel region is applied to the liquid crystals of the dummy pixel region, so that the reverse twisted domain is generated in the dummy pixel region.

Thus, the method for driving the liquid crystal display device according to the present invention is distinctive in respect that an optimum voltage, which is lower than an upper-limit voltage value by which a reverse twisted domain is generated and higher than a lower-limit voltage value by which a light leakage is generated in a boundary area between the display pixel region and the dummy pixel region, is applied to liquid crystals of at least a part of the dummy pixel region.

In the present invention, as described above, the upper-limit voltage value by which the reverse twisted domain is generated in the dummy pixel region and the lower-limit voltage by which the light leakage is generated in the boundary area between the display pixel region and the dummy pixel region are set, and the voltage within the limited range is applied as the optimum voltage to the liquid crystals of the dummy pixel region. Thereby, it is possible to prevent the defective indication due to the reverse twist and also to prevent the dispersion in the optical property in the boundary area between the display pixel region and the dummy pixel region. As a result, it enables to improve the picture quality of the liquid crystal display device.

Specifically, when setting the upper-limit voltage value and the lower-limit voltage value, it is desirable that the upper-limit voltage value be set lower than the maximum value of a video signal voltage to be applied to the pixel electrode of the display pixel region for an amount of voltage drop after one frame period, which is caused by a photoelectric current leakage of the switching element for drive-control of the pixel electrode. Further, it is desirable that the lower-limit voltage value be set larger than the minimum value of the voltage (video signal voltage) to be applied to the pixel electrodes of the display pixel region. The upper-limit voltage value and the lower-limit voltage value are to vary in accordance with the voltages to be applied to the display pixel electrode and the counter electrode, the property of the liquid crystal layer, etc., and are not determined based on a single factor, but rather determined based on measurements and calculator simulations performed on the liquid crystal display device which is to be actually drive-controlled.

Further, the present invention can be applied to transmission-type and reflection-type liquid crystal display devices. Furthermore, the switching element of the present invention is not limited to the transistor (TFT) formed on the glass substrate but a transistor device formed on a silicon substrate may be used. When the transistor device formed on the glass substrate is used, transmission display and reflection display can be performed. Further, when the transistor device formed on the silicon substrate is used, reflection display can be performed.

DESCRIPTION OF THE PREFERRED EMBODIMENTS

Embodiments of the present invention will be described hereinafter.

Figure 1:
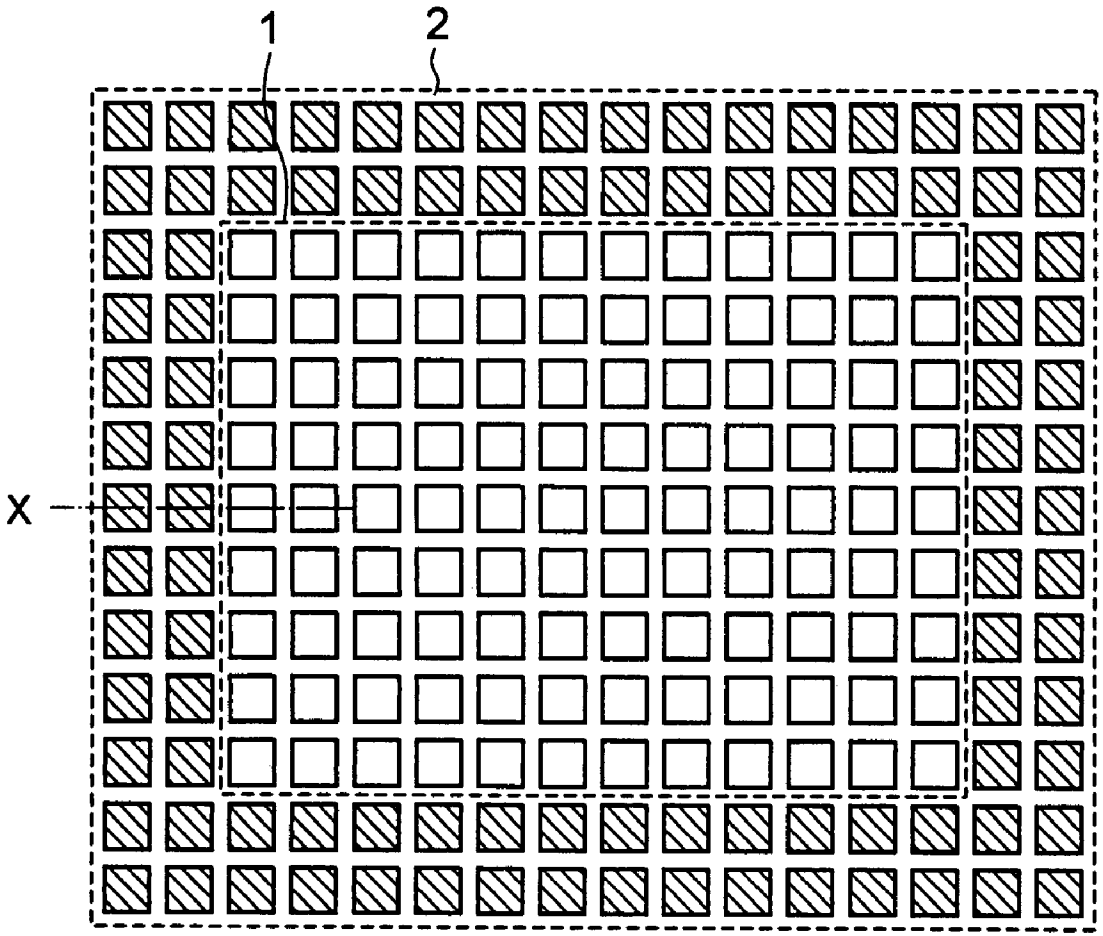
FIG. 1 PRIOR ART
FIG. 1 is a plan view for showing a pixel region of a conventional art.
Figure 2:
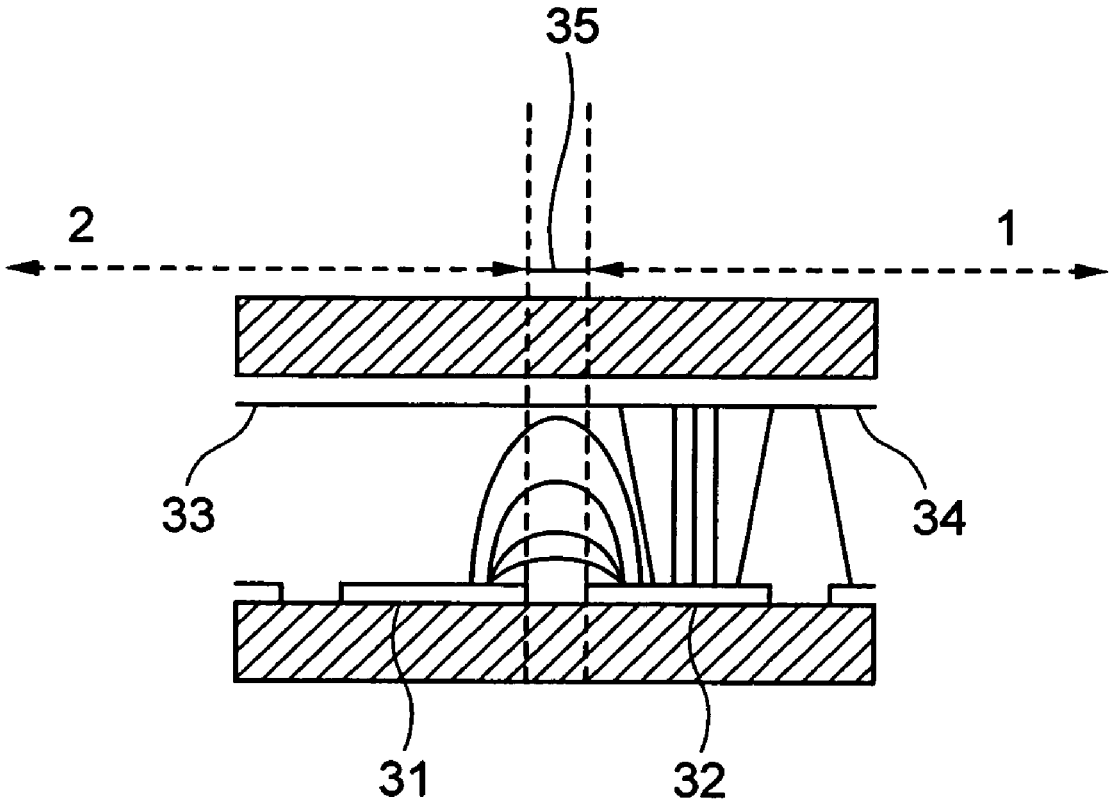
FIG. 2 PRIOR ART
FIG. 2 is a cross section taken along the line X of FIG. 1.
Figure 3:
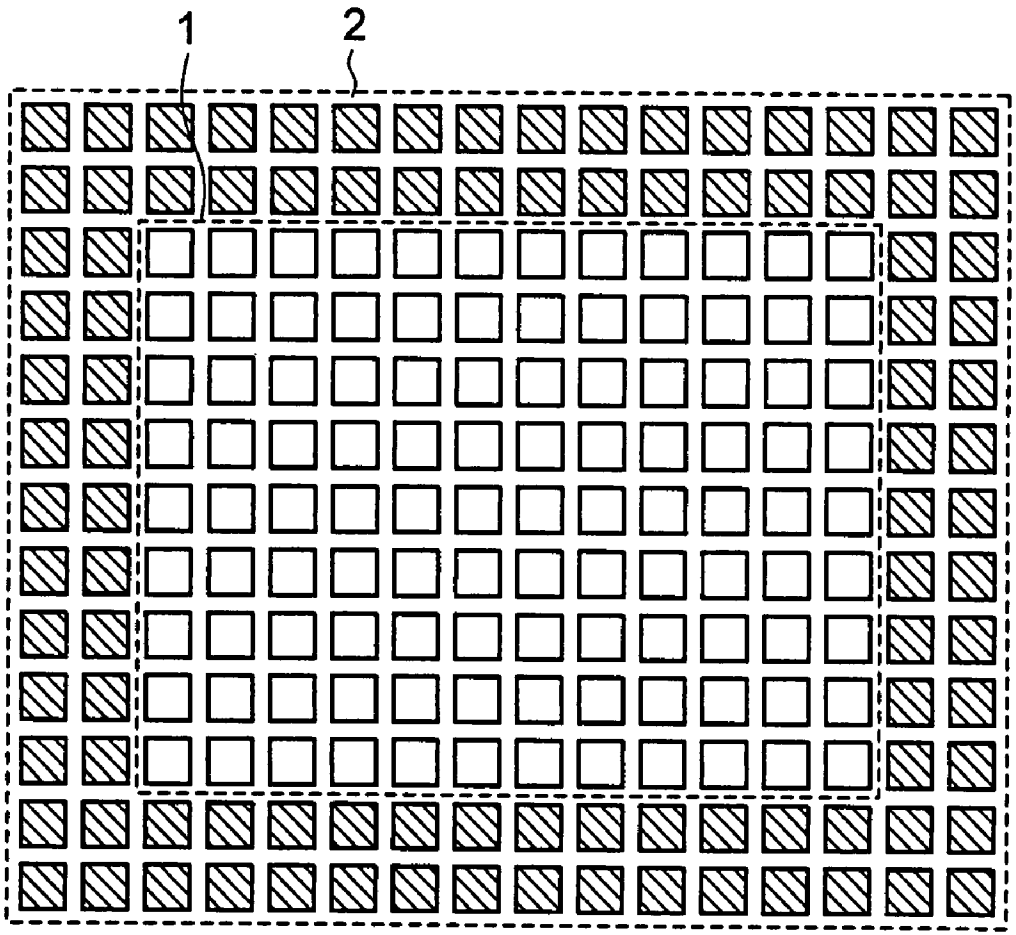
FIG. 3 is a plan view for showing a pixel region of an embodiment of the present invention.

A liquid crystal display device according to an embodiment of the present invention is an active-matrix type liquid crystal display device using TFT as a switching element. The liquid crystal display device according to the present invention comprises: a pixel substrate in which a plurality of pixel electrodes are formed in matrix; a counter substrate in which counter electrodes are formed; and liquid crystals (liquid crystal layer) filled in between the substrates (see FIG. 2). As shown in FIG. 3, the pixel substrate according to the embodiment comprises a pixel region constituted of pixel electrode groups. The pixel region is formed with a display pixel region 1 used for displaying an image and a dummy pixel region 2 disposed in the periphery of the display pixel region. The pixel region shown in FIG. 3 comprises the rectangular display pixel region 1 and the dummy pixel region 2 formed in a frame shape in the periphery of the display pixel region. The description in the followings will be presented by referring to the case of the pixel region shown in FIG. 3, however, the shape of the pixel region is not limited to the one shown in FIG. 3.

Figure 4:
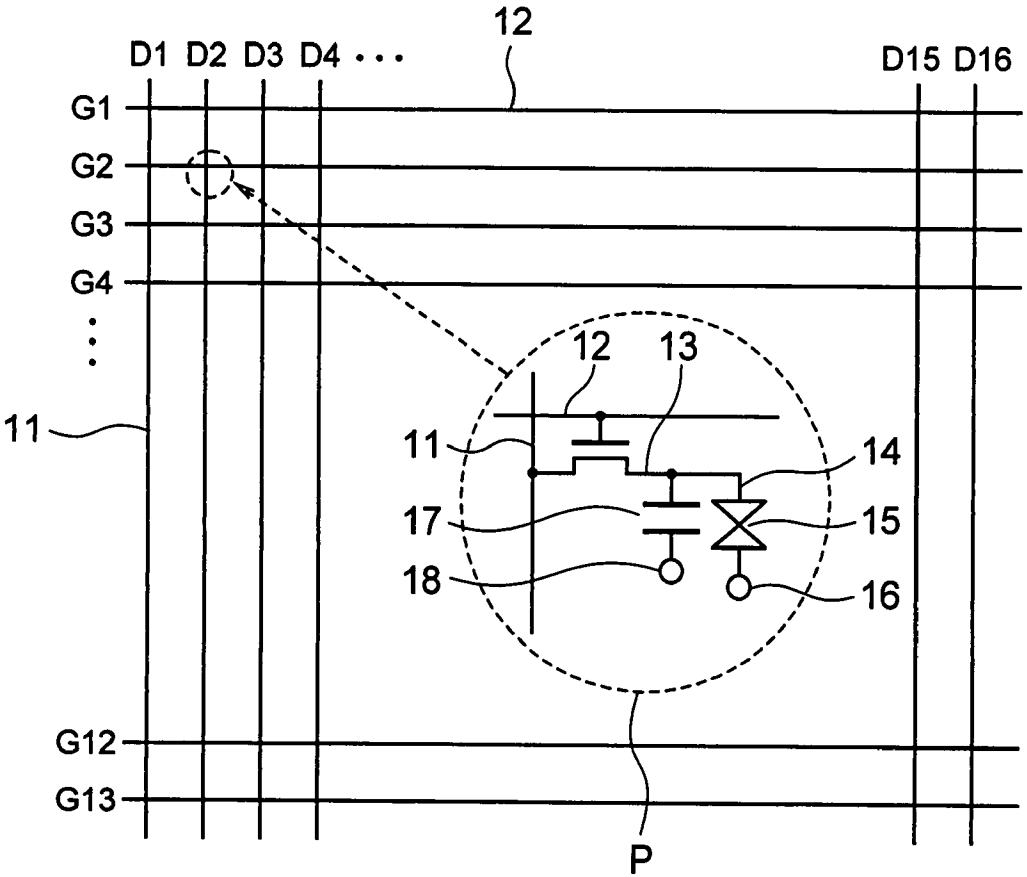
FIG. 4 is an equivalent circuit diagram for showing the pixel region of FIG. 3.

FIG. 4 shows the equivalent circuit of the pixel region 2 shown in FIG. 3. As shown in FIG. 4, disposed in the pixel region 2 are a plurality of gate lines 12 (G1-G13) arranged in parallel in the horizontal direction and a plurality of data lines 11 (D1-D16) arranged in parallel in the vertical direction. Also, pixels P containing a switching element (TFT), the pixel electrode and the liquid crystal are disposed in matrix at each intersection point between the gate lines 12 and the data lines 11.

The pixel P shown in FIG. 4 will be described in detail. A TFT 13 is provided in the vicinity of each intersection point between the data line 11 and the gate line 12. The gate electrode of the TFT 13 is coupled to the gate line 12, the source electrode of the TFT 13 is coupled to the data line 11, and the drain electrode of the TFT 13 is coupled to a pixel electrode 14. The pixel electrode 14 forms a liquid crystal capacitance 15 in between a counter electrode 16 and also is coupled to a storage capacitance 17. The side of the storage capacitance 17, which is not coupled to the pixel electrode 14, is coupled to a storage capacitance line 18. Although the gate line 12 is used herein as the scanning line, the scanning line is not limited to the gate line 12 as long as it can supply a control signal to the TFT for performing ON/OFF control of the TFT. Further, although the data line is used as the signal line, the signal line is not limited to the data line as long as it can apply the video signal voltage to the TFT.

As shown in FIG. 3, among the pixel region, the dummy pixel region 2 in a frame shape shown by a slash line does not have an aperture but the display pixel region 1 disposed on the inner side than the dummy pixel region 2 has the aperture. However, except for this, the structures of the pixels in both pixel regions are the same.

In the embodiment of the present invention, the number of pixels in the pixel region is not limited to any number. However, in the embodiment shown in FIG. 3, for conveniences' sake, illustrated as the display pixel region 1 is a matrix of nine pixels in vertical direction×fifteen pixels in horizontal direction, and dummy pixels in two rows on the left and right and two columns on top and bottom are disposed as the dummy pixel region 2 in the periphery of the display pixel region 1. Also, TFT is used as the switching element, however, it is not limited to this. Any device can be used as the switching element as long as it can perform display according to a display signal supplied from the signal line by being ON/OFF controlled according to the control signal supplied from the scanning line.

The method for driving the liquid crystal display device according to the embodiment of the present invention is a method for driving the liquid crystal display device which comprises a pixel region in which pixels containing a switching element, a pixel electrode, and a liquid crystal are arranged at each intersection point between a plurality of scanning lines being arranged in parallel in a horizontal direction and a plurality of signal lines being arranged in parallel in a vertical direction, and the pixel region is constituted of a display pixel region used for displaying an image and a dummy pixel region arranged in a periphery of the display pixel region, the method being used at the time of driving the liquid crystal display device according to the control signal supplied from the scanning line and the video signal voltage supplied from the signal line. In the method, an optimum voltage, which is lower than an upper-limit voltage value by which a reverse twisted domain is generated and higher than a lower-limit voltage value by which a light leakage is generated in a boundary area between the display pixel region and the dummy pixel region, is applied to liquid crystals of at least a part of the dummy pixel region.

It is desirable that the upper-limit voltage value be set lower than the maximum value of a video signal voltage to be applied to the liquid crystal of the display pixel region for an amount of voltage drop after one frame period caused by a photoelectric current leakage of the switching element. However, if there is almost no voltage drop due to the photoelectric current leakage, the upper-limit voltage value may be set smaller than the maximum value of a video signal voltage to be applied to the liquid crystal of the display pixel region. It is desirable that the lower-limit voltage value be set larger than the minimum value of the video signal voltage to be applied to the pixel electrode of the display pixel region.

Further, values of the optimum voltage may be set as a plurality of different values which, as a result of a plurality of application to the liquid crystals in the dummy pixel region, are lower than the upper-limit voltage value and are also higher than the lower-limit voltage value.

Further, the optimum voltage for m-time (n>m) frame among continuous n-time frames may be set as the maximum value of the video signal voltage to be applied to the liquid crystal of the display pixel region or larger than the maximum value; and the optimum voltage for the remaining (n−m) frames may be set as the minimum value of the video signal voltage to be applied to the liquid crystal of the display pixel region or smaller than the minimum value.

Next, a case of driving the liquid crystal display device according to the embodiment of the present invention by a gate line inversion driving method will be described as a first embodiment. The first embodiment will be described by referring to FIG. 5, FIG. 6, and FIG. 7.

Figure 5:
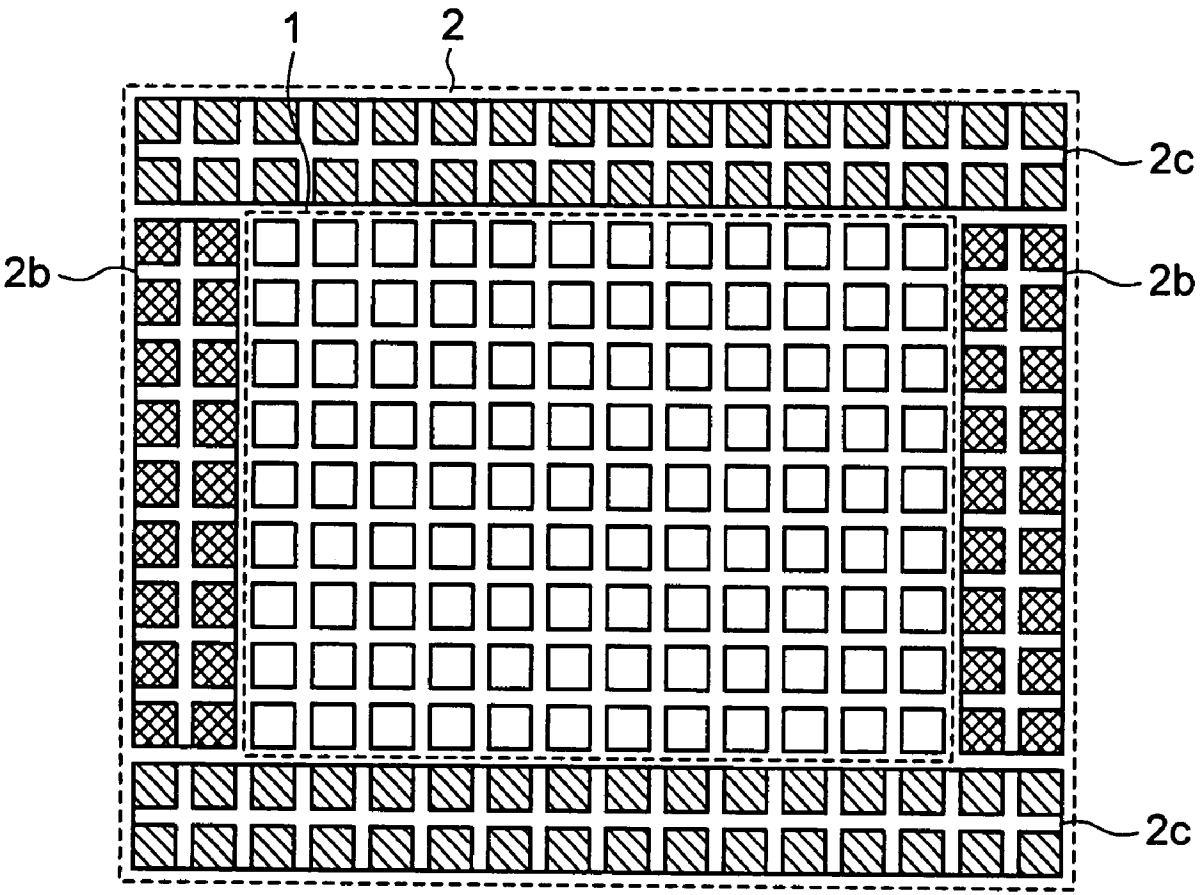
FIG. 5 is a plan view for showing a detailed example of the pixel region according to a first embodiment of the present invention.

As shown in FIG. 5, in the method for driving the liquid crystal display device according to the first embodiment of the present invention, a vertically long dummy pixel region 2*b* disposed in the left and right sides of the display pixel region 1 and horizontally long dummy pixel region 2*c* disposed on top and bottom sides of the display pixel region 1 are set as the dummy pixel region, and different voltages which will be described in detail in the followings are respectively applied to each of the two dummy pixel regions 2*b*, 2*c*. Specifically, in the first embodiment, at the time of actuating the device by a scanning line inversion driving method, the optimum voltage, which is lower than the upper-limit voltage value by which the reverse twisted domain is generated and higher than the lower-limit voltage by which the light leakage is generated in the boundary area between the display pixel region 1 and the dummy pixel region 2*b*, is applied to the liquid crystals of the dummy pixel region 2*b* being disposed in the left and right of the display pixel region 1, while the voltage larger than the lower-limit voltage value is applied to the liquid crystals of the dummy pixel region 2*c* being disposed on top and bottom of the display pixel region 1. In the first embodiment, TFT as shown in FIG. 4 is used as the switching element for controlling the pixel electrodes of the display pixel region 1 and those of the dummy pixel regions 2*b*, 2*c*.

It is desirable that the upper-limit voltage value be set lower than the maximum value of a video signal voltage to be applied to the liquid crystal of the display pixel region for an amount of voltage drop after one frame period caused by a photoelectric current leakage of the TFT. However, if there is almost no voltage drop due to the photoelectric current leakage, the upper-limit voltage value may be set smaller than the maximum value of a video signal voltage to be applied to the liquid crystal of the display pixel region. It is desirable that the lower-limit voltage value be set larger than the minimum value of the video signal voltage to be applied to the pixel electrode of the display pixel region.

Figure 6:
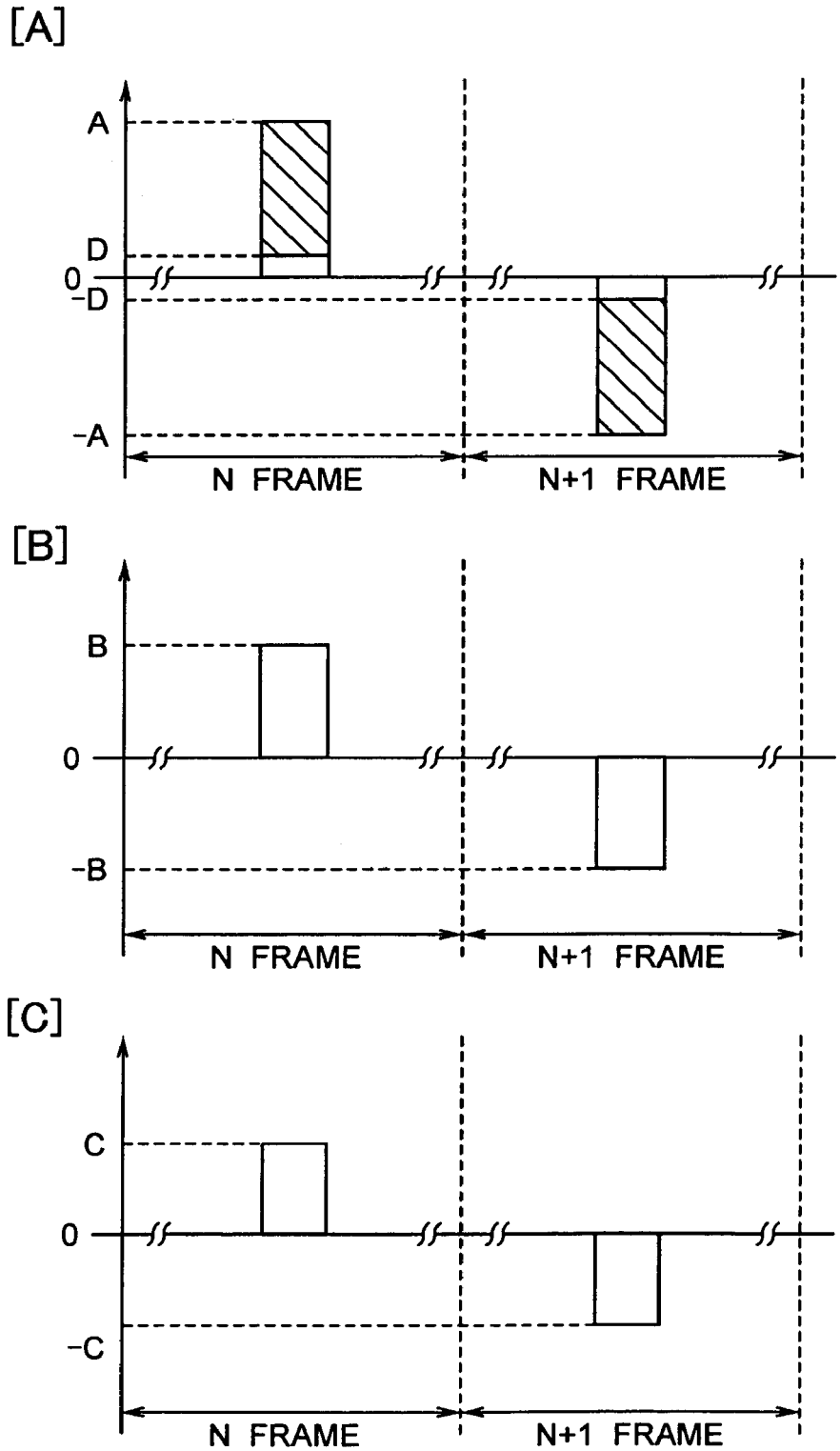
FIG. 6[A] is a timing chart of the video signal voltage which is applied to the pixel electrode of the display pixel region, FIG. 6[B] is a timing chart of the video signal voltage which is applied to the pixel electrode of the first dummy pixel region, and FIG. 6[C] is a timing chart of the video signal voltage which is applied to the pixel electrode of the second dummy pixel region.

In the first embodiment, FIG. 6[A] shows the timing of the video signal voltage applied to an arbitrary pixel electrode which is positioned in the display pixel region 1 shown in FIG. 5. FIG. 6[B] shows the timing of the voltage applied to an arbitrary pixel electrode which is positioned in the dummy pixel region 2*b* shown in FIG. 5. FIG. 6[C] shows the timing of the voltage applied to an arbitrary pixel electrode which is positioned in the dummy pixel region 2*c* shown in FIG. 5. The vertical axes in FIG. 6[A]-FIG. 6[C] represent the voltage and 0-point is the potential of the counter electrode 16. That is, the vertical axes in FIG. 6 show the difference in the voltages applied to the counter electrode 16 and the pixel electrode 14 of the liquid crystals and the polarities of the applied voltages.

The sections filled with the slash lines in FIG. 6[A] show the range of the video signal voltage, which changes according to the display picture data, in which A shows the maximum value of the video signal voltage to be applied to the pixel electrode of the display pixel region 1 and D shows the minimum value. In the embodiment, FIG. 7[A], which corresponds to FIG. 6[A] shows the timing of applying the voltage to the pixel electrode of the display pixel region 1, which is adjacent to the top or bottom of the pixel electrode to which the video signal voltage is applied at the timing shown in FIG. 6[A].

Figure 7:
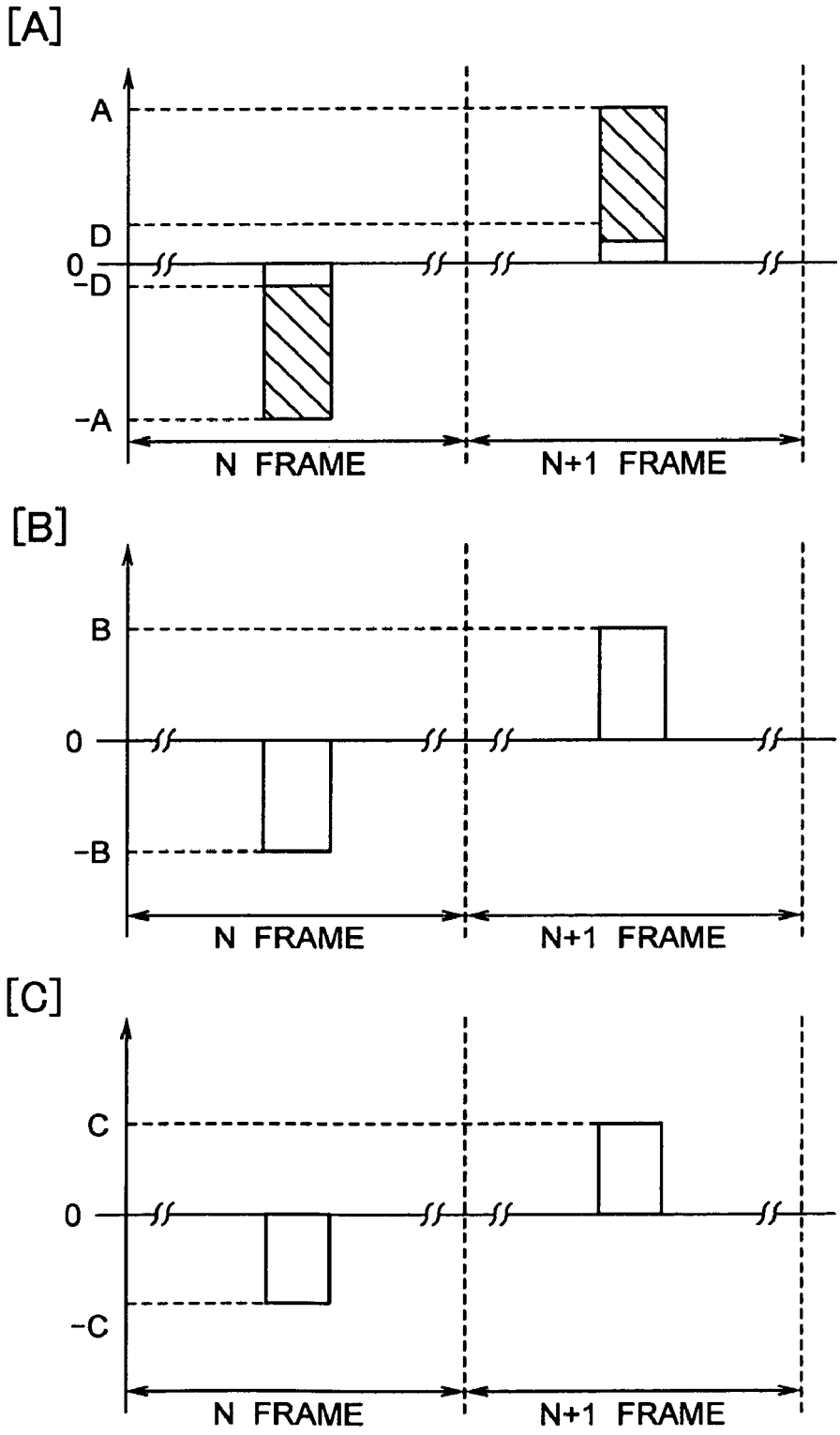
FIG. 7[A] is a timing chart of the video signal voltage which is applied to other pixel electrodes of the display pixel region, FIG. 7[B] is a timing chart of the video signal voltage which is applied to other pixel electrodes of the first dummy pixel region, and FIG. 7[C] is a timing chart of the video signal voltage which is applied to other pixel electrode of the second dummy pixel region.

FIG. 6[B] shows the timing by which a voltage B is applied to an arbitrary pixel electrode of the dummy pixel region 2*b* shown in FIG. 5 by changing the polarity for each frame. In the first embodiment, FIG. 7[B], which corresponds to FIG. 6[B], shows the timing of applying the voltage to the pixel electrode of the dummy pixel region 2*b* being adjacent to the top or bottom of the pixel electrode to which the voltage is applied at the timing shown in FIG. 6[B]. FIG. 6[C] shows the timing by which a voltage C is applied to an arbitrary pixel electrode of the dummy pixel region 2*c* shown in FIG. 5 by changing the polarity for each frame. FIG. 7[C], which corresponds to FIG. 6[C], shows the timing of applying the voltage to the pixel electrode of the dummy pixel region 2*c* being adjacent to the top or bottom of the pixel electrode to which the video signal voltage is applied at the timing shown in FIG. 6[C].

For driving the liquid crystals of the display pixel region 1 and the dummy pixel regions 2*b* and 2*c*, as shown in FIG. 4, when the signal for switching ON the TFT 13 coupled to each pixel electrode 12 is inputted to the gate line 12, all the TFTs 13 for one line coupled to the gate line 12 to which the ON signal is inputted are switched ON simultaneously. When the TFTs 13 are switched ON, the video signal voltage according to the display picture data is applied to the pixel electrodes 14 of the display pixel region 1 and the dummy pixel regions 2*b*, 2*c* from the data line 11. The applied video signal voltage is held by the liquid crystal capacitance 15 and the storage capacitance 17 even after the TFT 13 is switched OFF. By performing these actions in order from the gate line G1 to the gate line G13, the video signal voltage is applied to the pixel electrodes 14 of the display pixel region 1 and the dummy pixel regions 2*b*, 2*c*, and the transmissivity of the liquid crystal changes due to the difference between the voltages applied to the pixel electrodes 14 and the counter electrodes 16. Thereby, characters, pictures, and the like are displayed in the display pixel region 1 and the liquid crystals of the dummy pixel region 2 also behaves according to the difference between the voltages applied to the pixel electrodes 14 and the counter electrodes 16.

When a direct-current voltage is continued to be applied to the liquid crystal of the display pixel region 1 and the dummy pixel regions 2*b*, 2*c* for a long time, impurity ions move towards the pixel electrode 14 and the counter electrode 16. Thus, the capacitance of the liquid crystal layer is altered due to the impurity ions gathered to the electrode in an unbalanced manner. Therefore, compared to the state before the impurity ions are gathered, the effective electric field inside the liquid crystal layer is altered. As a result, a proper electric field cannot be applied to the liquid crystals. In order to prevent such phenomenon, as shown in FIG. 6[A]-FIG. 6[C], an alternate current drive is performed, in which the video signal voltage is applied in such a manner that the polarity of the potential of the pixel electrode 14 for the counter electrode 16 is reversed for N frame and N+1 frame.

In the first embodiment, since it is the gate line reverse drive, when the reverse twisted domain is generated in the dummy pixel region 2*b* shown in FIG. 5, the reverse twist propagates along the gate line. Thus, a defective indication with a horizontal line is generated in the display pixel region 1. In order to prevent this, the voltage B of FIG. 6[B] is set smaller than the voltage A of FIG. 6[A] at least for the amount of the voltage drop due to the photoelectric current leakage which is generated when the video signal voltage A is applied to the display pixel region 1.

However, if the voltage B is too small, a light leakage is generated in the boundary area between the display pixel region 1 and the dummy pixel region 2*b*. In order to prevent generation of the reverse twisted domain and the light leakage in the boundary area between the display pixel region 1 and the dummy pixel region 2*b*, the voltage B is set to be smaller than the voltage A at least for the amount of the voltage drop due to the photoelectric current leakage caused at the time of applying the video signal voltage A to the display pixel region 1 and also to be in the extent by which the light leakage cannot be recognized in the boundary area between with the dummy pixel region 2*b* when the video signal voltage A is applied over the entire pixels of the display pixel region 1.

When the reverse twisted domain is generated in the dummy pixel region 2*c* shown in FIG. 5, the reverse twist propagates along the gate line 12. However, the gate line 12 positioned in the dummy pixel region 2*c* and the gate line 12 of the display pixel region 1 are separated so that the reverse twist generated within the dummy pixel region 2*c* does not spread to the display pixel region 1. Thus, it is not necessary to set the upper limit of the extent of a voltage C to be applied to the liquid crystals of the dummy pixel region 2*c*. However, the lower limit is set to be in the extent by which the light leakage cannot be recognized in the boundary area between with the dummy pixel region 2*c* when the video signal voltage A is applied over the entire pixel electrodes of the display pixel region 1.

By performing the drive as described above, in the first embodiment, generation of the reverse twisted domain within the dummy pixel region 2*b* shown in FIG. 5 is suppressed. Thereby, it is possible to prevent the defective indication caused by the reverse twist and to prevent the light leakage in the boundary area between the dummy pixel regions 2*b*, 2*c* and the display pixel region 1.

Figure 8:
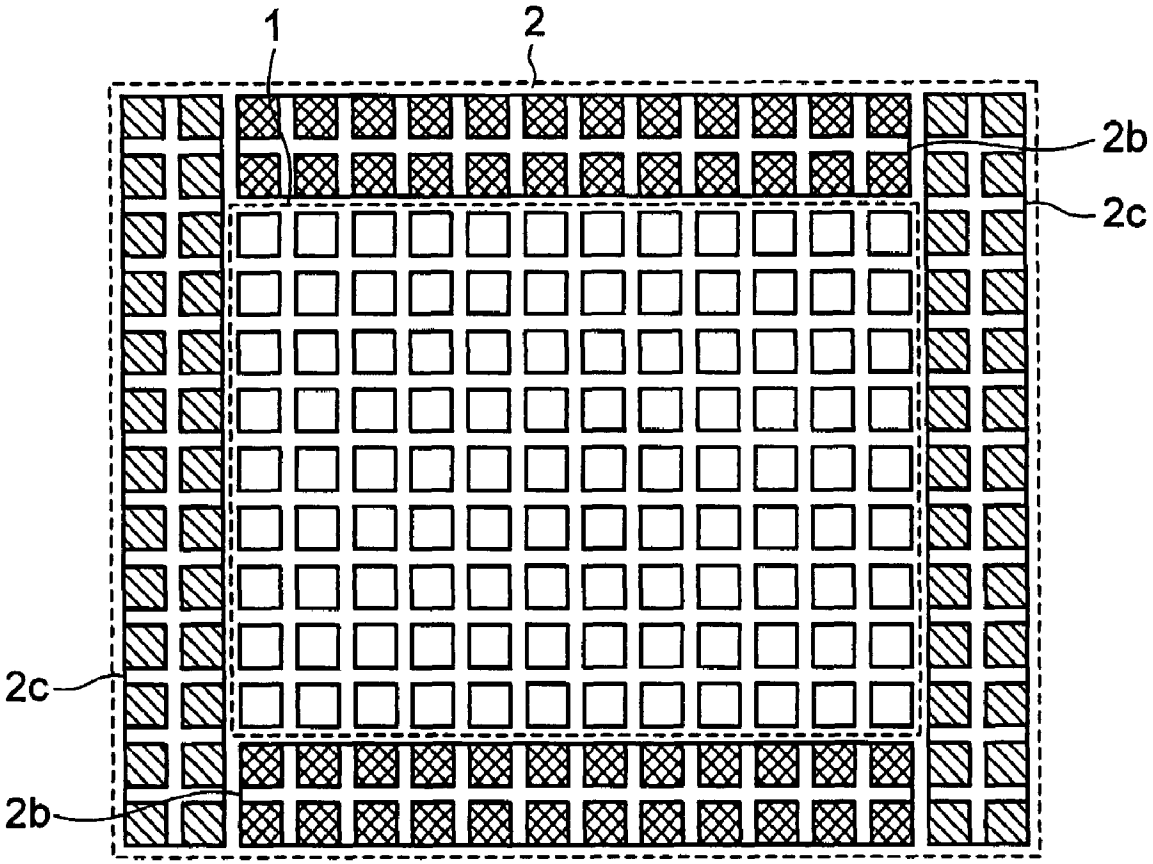
FIG. 8 is a plan view for showing the pixel region in the second embodiment of the present invention.

Next, a case of driving the liquid crystal display device according to the embodiment of the present invention using a data line inversion driving method will be described as a second embodiment. FIG. 8 is an illustration for describing the action of the second embodiment. The action of applying the voltage to the pixel electrode described in FIG. 4 is the same in the second embodiment, so that the description will be omitted.

As shown in FIG. 8, in the method for driving the liquid crystal display device according to the second embodiment of the present invention, a vertically long dummy pixel region 2*c* disposed in the left and right sides of the display pixel region 1 and horizontally long dummy pixel region 2*b* disposed on top and bottom sides of the display pixel region 1 are set as the dummy pixel region, and different voltages which will be described in detail in the followings are respectively applied to each of the two dummy pixel regions 2*b*, 2*c*. Specifically, in the second embodiment, at the time of actuating the device by a data line inversion driving method, the optimum voltage, which is lower than the upper-limit voltage value by which the reverse twisted domain is generated and higher than the lower-limit voltage by which the light leakage is generated in the boundary area between the display pixel region 1 and the dummy pixel region 2*b*, is applied to the liquid crystals of the dummy pixel region 2*b* being disposed on top and bottom of the display pixel region 1, while the voltage larger than the lower-limit voltage value is applied to the liquid crystals of the dummy pixel region 2*c* being disposed in the left and right of the display pixel region 1. In the second embodiment, TFT as shown in FIG. 4 is used as the switching element for controlling the pixel electrodes of the display pixel region 1 and those of the dummy pixel regions 2*b*, 2*c*.

It is desirable that the upper-limit voltage value be set lower than the maximum value of a video signal voltage to be applied to the liquid crystal of the display pixel region for an amount of voltage drop after one frame period caused by a photoelectric current leakage of the TFT. However, if there is almost no voltage drop due to the photoelectric current leakage, the upper-limit voltage value may be set lower than the maximum value of a video signal voltage to be applied to the liquid crystal of the display pixel region. It is desirable that the lower-limit voltage value be set larger than the minimum value of the video signal voltage to be applied to the pixel electrode of the display pixel region.

In the second embodiment, FIG. 6[A] shows the timing of applying the video signal voltage to an arbitrary pixel electrode which is positioned in the display pixel region 1 shown in FIG. 8. In the second embodiment, FIG. 7[A], which corresponds to FIG. 6[A], shows the timing of applying the voltage to the pixel electrode of the display pixel region 1 being adjacent to the left or right of the pixel electrode to which the video signal voltage is applied at the timing shown in FIG. 6[A]. In the second embodiment, FIG. 6[B] shows the timing of applying the voltage to an arbitrary pixel electrode which is positioned in the dummy pixel region 2*b* shown in FIG. 8. In the second embodiment, FIG. 7[B], which corresponds to FIG. 6[B], shows the timing of applying the voltage to the pixel electrode of the dummy pixel region 2*b* being adjacent to the left or right of the pixel electrode to which the voltage is applied at the timing shown in FIG. 6[B]. In the second embodiment, FIG. 6[C] shows the timing of applying the voltage to an arbitrary pixel electrode which is positioned in the dummy pixel region 2*c* shown in FIG. 8. In the second embodiment, FIG. 7[C], which corresponds to FIG. 6[C], shows the timing of applying the voltage to the pixel electrode of the dummy pixel region 2*c* being adjacent to the left or right of the pixel electrode to which the voltage is applied at the timing shown in FIG. 6[C].

In the second embodiment, since it is the data line reverse drive, when the reverse twisted domain is generated in the dummy pixel region 2*b* shown in FIG. 8, the reverse twist propagates along the data line. Thus, a defective indication with a horizontal line is generated in the display pixel region 1. In order to prevent this, the voltage B of FIG. 6[B] is set smaller than the voltage A of FIG. 6[A] at least for the amount of the voltage drop due to the photoelectric current leakage which is generated when the video signal voltage A is applied to the display pixel region 1.

However, if the voltage B is too small, a light leakage is generated in the boundary area between the display pixel region 1 and the dummy pixel region 2. In order to prevent generation of the reverse twisted domain and the light leakage in the boundary area between the display pixel region 1 and the dummy pixel region 2*b*, the voltage B is set to be smaller than the voltage A at least for the amount of the voltage drop due to the photoelectric current leakage caused at the time of applying the video signal voltage A to the display pixel region 1 and also to be in the extent by which the light leakage cannot be recognized in the boundary area between with the dummy pixel region 2 when the video signal voltage A is applied over the entire pixels of the display pixel region 1.

When the reverse twisted domain is generated in the dummy pixel region 2*c* shown in FIG. 8, the reverse twist propagates along the data line 11. However, the data line 11 positioned in the dummy pixel region 2*c* and the data line 11 of the display pixel region 1 are separated so that the reverse twist generated within the dummy pixel region 2*c* does not spread to the display pixel region 1. Thus, it is not necessary to set the upper limit of the extent of a voltage C to be applied to the pixel electrodes of the dummy pixel region 2*c*. However, the lower limit is set to be in the extent by which the light leakage cannot be recognized in the boundary area between with the dummy pixel region 2*c* when the video signal voltage A is applied over the entire (all) pixel electrodes of the display pixel region 1.

By performing the drive as described above, in the second embodiment, generation of the reverse twisted domain within the dummy pixel region 2*b* shown in FIG. 8 is suppressed. Thereby, it is possible to prevent the defective indication caused by the reverse twist and to prevent the light leakage in the boundary area between the dummy pixel regions 2*b*, 2*c* and the display pixel region 1.

Next, a case of driving the liquid crystal display device according to the embodiment of the present invention using a dot inversion driving method will be described as a third embodiment. FIG. 3 is used for describing the third embodiment. However, description of the same configuration as that of the first embodiment will be omitted. The action of applying the voltage to the pixel electrode described in FIG. 4 is also the same in the third embodiment, so that the description will be omitted.

In the dot inversion driving method according to the third embodiment, as shown in FIG. 3, the dummy pixel region 2 is set in the periphery of the display pixel region 1, and at the time of actuating the device by the dot inversion driving method, the optimum voltage, which is lower than the upper-limit voltage value by which the reverse twisted domain is generated and higher than the lower-limit voltage by which the light leakage is generated in the boundary area between the display pixel region 1 and the dummy pixel region 2*b*, is applied to the liquid crystal of the dummy pixel region 2 disposed in the periphery of the display pixel region 1. In the third embodiment, TFT as shown in FIG. 4 is used as the switching element for controlling the pixel electrodes of the display pixel region 1 and those of the dummy pixel regions 2*b*, 2*c*.

It is desirable that the upper-limit voltage value be set lower than the maximum value of a video signal voltage to be applied to the liquid crystal of the display pixel region for an amount of voltage drop after one frame period caused by a photoelectric current leakage of the TFT. However, if there is almost no voltage drop due to the photoelectric current leakage, the upper-limit voltage value may be set lower than the maximum value of a video signal voltage to be applied to the liquid crystal of the display pixel region.

In the third embodiment, FIG. 6[A] shows the timing of applying the video signal voltage to an arbitrary pixel electrode which is positioned in the display pixel region 1 shown in FIG. 3. In the third embodiment, FIG. 7[A], which corresponds to FIG. 6[A], shows the timing of applying the voltage to the pixel electrode of the display pixel region 1 being adjacent to the top and bottom, left and right of the pixel electrode to which the video signal voltage is applied at the timing shown in FIG. 6[A]. In the third embodiment, FIG. 6[B] shows the timing of applying the voltage to an arbitrary pixel electrode which is positioned in the dummy pixel region 2 shown in FIG. 3. In the third embodiment, FIG. 7[B], which corresponds to FIG. 6[B], shows the timing of applying the voltage to the pixel electrode of the dummy pixel region 2 being adjacent to the top and bottom, the left and right of the pixel electrode to which the voltage is applied at the timing shown in FIG. 6[B].

In the third embodiment, in order to prevent generation of the reverse twisted domain, the voltage B which is applied to the pixel electrode of the dummy pixel region 2 shown in FIG. 3 is set smaller than the voltage A of FIG. 6[A] as shown in FIG. 3 at least for the amount of the voltage drop due to the photoelectric current leakage which is generated when the video signal voltage A is applied to the display pixel region 1.

However, if the voltage B is too small, a light leakage is generated in the boundary area between the display pixel region 1 and the dummy pixel region 2.

In order to prevent generation of the reverse twisted domain and the light leakage in the boundary area between the display pixel region 1 and the dummy pixel region 2*b*, the voltage B is set to be smaller than the voltage A at least for the amount of the voltage drop due to the photoelectric current leakage caused at the time of applying the video signal voltage A to the display pixel region 1 and also to be in the extent by which the light leakage cannot be recognized in the boundary area between with the dummy pixel region 2 when the video signal voltage A is applied over the entire pixels of the display pixel region 1.

By performing the drive as described above, in the third embodiment, generation of the reverse twisted domain within the dummy pixel region 2 shown in FIG. 3 is suppressed. Thereby, it is possible to prevent the defective indication caused by the reverse twist and to prevent the light leakage in the boundary area between the dummy pixel region 2 and the display pixel region 1.

Next, a fourth embodiment of the present invention will be described by referring to FIG. 3 and FIG. 9. In the fourth embodiment, it is supposed that the optimum voltage, which is lower than the upper-limit voltage value by which the reverse twisted domain is generated and higher than the lower-limit voltage value by which the light leakage is generated in the boundary area between the display pixel region and the dummy pixel region, is applied to the liquid crystals of at least a part of the dummy pixel region. Further, in the fourth embodiment, the values as a result of applying the optimum voltage the liquid crystals of the dummy pixel region for a plurality of times are a plurality of different values which are lower than the upper-limit voltage value and also higher than the lower-limit voltage value. Specifically, when driving the liquid crystals of the dummy pixel region 2 disposed in the periphery of the display pixel region 1 shown in FIG. 3, a voltage which is the minimum value of the voltage to be applied to the liquid crystals of the display pixel region 1 or larger than the minimum value is applied to the m-time frame among the continuous n-time frames, and a voltage for other frames (remaining frames (n−m)) is set to be the maximum value of the voltage to be applied to the liquid crystals of the display pixel region 1 or smaller. That is, the effective voltage to be applied to the liquid crystal of the dummy pixel region 2 when integrated for longer than the n-number frame periods becomes smaller than the maximum value of the voltage to be applied to the liquid crystals of the display pixel region 1. Further, n, mare integers and n>m. In the fourth embodiment, TFT as shown in FIG. 4 is used as the switching element for controlling the pixel electrodes of the display pixel region 1 and the dummy pixel region 2.

Figure 9:
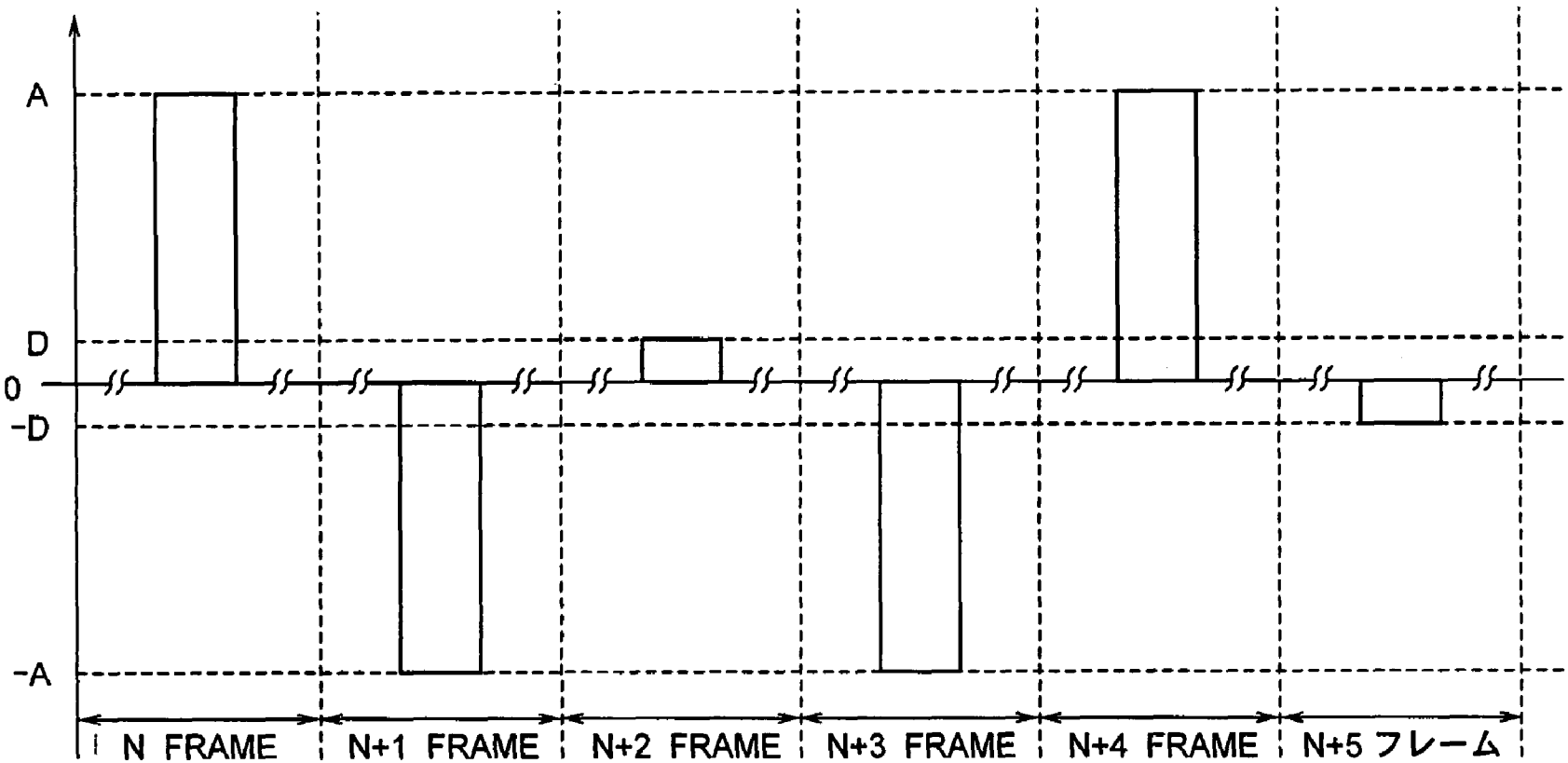
FIG. 9 is a timing chart of the video signal voltage which is applied to the dummy pixel electrode in the fourth embodiment of the present invention.

FIG. 9 shows the timing of applying the voltage to an arbitrary pixel electrode of the dummy pixel region 2 when n=3, m=1. The vertical axis of FIG. 9 is the voltage and the 0-point is the potential of the counter electrode. That is, the vertical axis of FIG. 9 shows the difference between the voltage applied to the counter electrode 16 and the voltage applied to the pixel electrode 14 of the liquid crystals of the dummy pixel region 2, and the polarities. Further, the voltage A of FIG. 9 is the maximum value of the video signal voltage to be applied to the pixel electrode of the display pixel region 1, and the voltage D of FIG. 9 is the minimum value of the video signal voltage to be applied to the pixel electrode of the display pixel region 1.

By performing the drive by the timing shown in FIG. 9, the reverse twisted domain generated at the time of applying the voltage D to the pixel electrode in the dummy pixel region 2 can be eliminated even if the reverse twisted domain is generated in the dummy pixel region 2 when the voltage A is applied to the pixel electrode in the dummy pixel region 2. Thus, the generated reverse twisted domain can be eliminated before it propagates to the display pixel region 1. By optimizing the number of m-time frames to which the voltage of the minimum value of the video signal voltage or larger is applied, it is possible to prevent the light leakage in the boundary area between with the dummy pixel even when the maximum video signal voltage A is applied to the entire pixels of the display pixel region 1.

By performing the drive as described above, in the fourth embodiment, it is possible to prevent the defective indication caused by the reverse twist in the display pixel region 1 shown in FIG. 3 and to prevent the light leakage in the boundary area between the dummy pixel region 2 and the display pixel region 1.

In the fourth embodiment, it is possible to drive the liquid crystal display device using the gate line inversion driving method, the data line inversion driving method, and the dot inversion driving method.

At the time of performing the gate line inversion driving method, by eliminating the reverse twisted domain generated in the dummy pixel region 2*b* shown in FIG. 5, generation of the reverse twisted domain within the display pixel region 1 shown in FIG. 5 can be prevented. Thus, the defective indication due to the reverse twist can be prevented.

Therefore, as for the gate line inversion driving method, it may be performed in such a manner that the driving method of the embodiment, which is to apply the different voltage to the dummy pixel region only to the m-time frame among the continuous n-time frames, is employed for the dummy pixel region 2*b* shown in FIG. 5, and the voltage by which the light leakage is not generated in the boundary area is applied over the entire continuous n-number frames for the dummy pixel region 2*c* shown in FIG. 5.

At the time of performing the data line inversion driving method, by eliminating the reverse twisted domain generated in the dummy pixel region 2*b* shown in FIG. 8, generation of the reverse twisted domain within the display pixel region 1 shown in FIG. 8 can be prevented. Thus, the defective indication due to the reverse twist can be prevented.

Therefore, as for the data line inversion driving method, it may be performed in such a manner that the driving method of the embodiment, which is to apply the different voltage to the dummy pixel region only to the m-time frame among the continuous n-time frames, is employed for the dummy pixel region 2*b* shown in FIG. 8, and the voltage by which the light leakage is not generated in the boundary area is applied over the entire continuous n-time frames for the dummy pixel region 2*c* shown in FIG. 8

Needless to say, the present invention is not limited to the first-fourth embodiments described above. Further, the method for driving the liquid crystal display device according to the present invention can be applied for driving a liquid crystal display device which is used for a liquid crystal TV, a liquid crystal monitor, a liquid crystal projector, and the like.

What is claimed is:

1. A method for driving a liquid crystal display device comprising:

a pixel region in which a pixel comprising a switching element, a pixel electrode, and a liquid crystal is arranged at each intersection point in matrix between a plurality of scanning lines arranged in parallel in a horizontal direction and a plurality of signal lines arranged in parallel in a vertical direction, wherein the pixel region comprises a display pixel region used for displaying an image and a dummy pixel region arranged around an outer periphery of the display pixel region, the dummy pixel region comprising a dummy pixel entirely covered by a shield film and having no aperture, the method comprising the step of:

applying an optimum voltage, which is lower than an upper-limit voltage value by which a reverse twisted domain is generated and higher than a lower-limit voltage value by which a light leakage is generated in a boundary area located between the display pixel region and the dummy pixel region, to liquid crystals of at least a part of the dummy pixel region.

2. The method for driving a liquid crystal display device according to claim 1, wherein the upper-limit voltage value is set lower than a maximum value of a video signal voltage to be applied to the liquid crystal of the display pixel region.

3. The method for driving a liquid crystal display device according to claim 1, wherein the upper-limit voltage value is set lower than a maximum value of a video signal voltage to be applied to the liquid crystal of the display pixel region for an amount of voltage drop after one frame period caused by a photoelectric current leakage of the switching element.

4. The method for driving a liquid crystal display device according to claim 1, wherein values of the optimum voltage are a plurality of different values which, as a result of a plurality of application to the liquid crystals in the dummy pixel region, are lower than the upper-limit voltage value and also higher than the lower-limit voltage value.

5. The method for driving a liquid crystal display device according to claim 1, wherein:

the optimum voltage for m-time (n>m) frame among continuous n-time frames is the minimum value of the video signal voltage to be applied to the liquid crystal of the display pixel region or larger than the minimum value; and the optimum voltage for remaining (n−m) frames is the maximum value of the video signal voltage to be applied to the liquid crystal of the display pixel region or smaller than the maximum value.

6. The method for driving a liquid crystal display device according to claim 1, comprising the steps of, at the time of actuating the liquid crystals by a scanning line inversion driving method:

applying the optimum voltage, which is lower than an upper-limit voltage value by which a reverse twisted domain is generated and higher than a lower-limit voltage value by which a light leakage is generated in a boundary area between the display pixel region and the dummy pixel region, to the liquid crystals of the dummy pixel region being arranged on the left and right of the display pixel region; and applying a voltage which is higher than the lower-limit voltage value to the liquid crystals of the dummy pixel region being arranged on top and bottom of the display pixel region.

7. The method for driving a liquid crystal display device according to claim 6, wherein the upper-limit voltage value is set lower than a maximum value of the video signal voltage to be applied to the liquid crystal of the display pixel region.

8. The method for driving a liquid crystal display device according to claim 6, wherein the upper-limit voltage value is set lower than a maximum value of a video signal voltage to be applied to the liquid crystal of the display pixel region for an amount of voltage drop after one frame period caused by a photoelectric current leakage of the switching element.

9. The method for driving a liquid crystal display device according to claim 6, wherein values of the optimum voltage are plurality of different values which, as a result of a plurality of application to the liquid crystals in the dummy pixel region, are lower than the upper-limit voltage value and also higher than the lower-limit voltage value.

10. The method for driving a liquid crystal display device according to claim 1, wherein, at the time of using a scanning line inversion driving method:

for m-time (n>m) frame among continuous n-time frames, the optimum voltage which is applied to the liquid crystals of the dummy pixel region arranged in left and right of the display pixel region is the minimum value of the video signal voltage to be applied to the liquid crystal of the display pixel region or larger than the minimum value; and for remaining (n−m) frames, the optimum voltage which is applied to the liquid crystals of the dummy pixel region arranged in left and right of the display pixel region is the maximum value of the video signal voltage to be applied to the liquid crystal of the display pixel region or smaller than the maximum value.

11. The method for driving a liquid crystal display device according to claim 1, comprising the steps of, at the time of using a signal line inversion driving method:

applying the optimum voltage, which is lower than an upper-limit voltage value by which a reverse twisted domain is generated and higher than a lower-limit voltage value by which a light leakage is generated in a boundary area between the display pixel region and the dummy pixel region, to the liquid crystals of the dummy pixel region being arranged on top and bottom of the display pixel region; and applying a voltage which is higher than the lower-limit voltage value to the liquid crystals of the dummy pixel region being arranged on the left and right of the display pixel region.

12. The method for driving a liquid crystal display device according to claim 11, wherein the upper-limit voltage value is set lower than the maximum value of the video signal voltage to be applied to the liquid crystal of the display pixel region.

13. The method for driving a liquid crystal display device according to claim 11, wherein the upper-limit voltage value is set lower than the maximum value of a video signal voltage to be applied to the liquid crystal of the display pixel region for an amount of voltage drop after one frame period caused by a photoelectric current leakage of the switching element.

14. The method for driving a liquid crystal display device according to claim 11, wherein values of the optimum voltage are plurality of different values which, as a result of a plurality of application to the liquid crystals in the dummy pixel region, are lower than the upper-limit voltage value and also higher than the lower-limit voltage value.

15. The method for driving a liquid crystal display device according to claim 1, wherein, at the time of using a signal line inversion driving method:

for m-time (n>m) frame among continuous n-time frames, the optimum voltage which is applied to the liquid crystals of the dummy pixel region arranged on top and bottom of the display pixel region is the minimum value of the video signal voltage to be applied to the liquid crystal of the display pixel region or larger than the minimum value; and for remaining (n−m) frames, the optimum voltage which is applied to the liquid crystals of the dummy pixel region arranged on top and bottom of the display pixel region is the maximum value of the video signal voltage to be applied to the liquid crystal of the display pixel region or smaller than the maximum value.

16. The method for driving a liquid crystal display device according to claim 1, comprising the steps of, at the time of using a dot inversion driving method:

applying the optimum voltage, which is lower than an upper-limit voltage value by which a reverse twisted domain is generated and higher than a lower-limit voltage value by which a light leakage is generated in a boundary area between the display pixel region and the dummy pixel region, to the liquid crystals of the dummy pixel region being arranged in the periphery of the display pixel region.

17. The method for driving a liquid crystal display device according to claim 16, wherein the upper-limit voltage value is set lower than the maximum value of the video signal voltage to be applied to the liquid crystal of the display pixel region.

18. The method for driving a liquid crystal display device according to claim 16, wherein the upper-limit voltage value is set lower than the maximum value of a video signal voltage to be applied to the liquid crystal of the display pixel region for an amount of voltage drop after one frame period caused by a photoelectric current leakage of the switching element.

19. The method for driving a liquid crystal display device according to claim 16, wherein values of the optimum voltage are plurality of different values which, as a result of a plurality of application to the liquid crystals in the dummy pixel region, are lower than the upper-limit voltage value and also higher than the lower-limit voltage value.

20. The method for driving a liquid crystal display device according to claim 16, wherein, at the time of using a dot inversion driving method:

for m-time (n>m) frame among continuous n-time frames, the optimum voltage which is applied to the liquid crystals of the dummy pixel region arranged in a periphery of the display pixel region is the minimum value of the video signal voltage to be applied to the liquid crystal of the display pixel region or larger than the minimum value; and for remaining (n−m) frames, the optimum voltage which is applied to the liquid crystals of the dummy pixel region arranged in the periphery of the display pixel region is the maximum value of the video signal voltage to be applied to the liquid crystal of the display pixel region or smaller than the maximum value.

21. The method for driving a liquid crystal display device according to claim 1, wherein a reverse twisted domain occurs when a voltage, which is applied to the dummy pixel region is the maximum value of a video signal voltage applied to the display pixel region.

22. The method for driving a liquid crystal display device according to claim 1, wherein light leakage occurs when a voltage is applied to the display pixel region such that a boundary between the dummy pixel region and the display pixel region appears white.

* * * * *